US007748153B2

(12) United States Patent
Beretta

(10) Patent No.: US 7,748,153 B2
(45) Date of Patent: Jul. 6, 2010

(54) FIREARM GRIP, PARTICULARLY OF A GUN

(75) Inventor: Ugo Gussalli Beretta, Brescia (IT)

(73) Assignee: Fabrica D/Armi Pietro Beretta S.p.A., Brescia (IT)

( * ) Notice: Subject to any disclaimer, the term of this patent is extended or adjusted under 35 U.S.C. 154(b) by 1101 days.

(21) Appl. No.: 11/260,379

(22) Filed: Oct. 28, 2005

(65) Prior Publication Data

US 2006/0096147 A1 May 11, 2006

(30) Foreign Application Priority Data

Nov. 11, 2004 (IT) ..... MI2004A2166

(51) Int. Cl.
*F41C 23/10* (2006.01)

(52) U.S. Cl. ..... 42/71.02; 89/1.42

(58) Field of Classification Search ..... 42/71.01, 42/71.02, 72, 73, 74; 89/1.42; D22/104
See application file for complete search history.

(56) References Cited

U.S. PATENT DOCUMENTS 4,043,066 A * 8/1977 Pachmayr et al. ..... 42/71.02
4,199,887 A * 4/1980 Hogue ..... 42/71.02
4,286,401 A 9/1981 Pachmayr et al.
4,397,109 A * 8/1983 Pachmayr et al. ..... 42/50
4,586,282 A * 5/1986 Sniezak ..... 42/71.02
4,602,450 A * 7/1986 Hoenig ..... 42/75.02
4,833,812 A * 5/1989 Farrar ..... 42/71.02
D305,923 S * 2/1990 Ferraro et al. ..... D22/104
4,936,036 A 6/1990 Sniezak et al.
5,231,237 A * 7/1993 Cupp ..... 42/71.02
D374,903 S * 10/1996 Pearce ..... D22/108
5,768,817 A * 6/1998 Simons ..... 42/71.02
6,112,446 A 9/2000 Förester et al.
6,301,818 B1 * 10/2001 Hogue ..... 42/71.02
6,802,148 B1 10/2004 Danas
6,964,382 B2 * 11/2005 Alexander et al. ..... 239/526
2006/0162222 A1 * 7/2006 Beretta ..... 42/72
2008/0060247 A1 * 3/2008 Thomele et al. ..... 42/71.02

* cited by examiner

*Primary Examiner*—Benjamin P Lee
(74) *Attorney, Agent, or Firm*—Hogan Lovells US LLP

(57) ABSTRACT

A grip (10) of a firearm (12), particularly of a gun, comprises a body (14) extending substantially in a development direction (16) and a gripping portion (20) removably mounted on the body (14) in a rear area with reference to a trigger of the weapon. The gripping portion (20) at least partially envelops and covers a rear surface (14*a*) and a tract of side surfaces (14*b*) of the body (14). Means for locking the gripping portion (20) on the body (14) operating in an inserting direction (24) transversal to the development direction (16) are arranged in at least one side portion of the body (14) and the gripping portion (20) and comprise first strikes (52) associated with the gripping portion (20) and offset in the development direction (16) relative to second strikes (54) associated with the body. Interference means are interposed between the first and second strikes (52, 54) for locking the gripping portion (20).

43 Claims, 7 Drawing Sheets

FIREARM GRIP, PARTICULARLY OF A GUN

FIELD OF THE INVENTION

The object of the present invention is a firearm grip, particularly of a gun.

BACKGROUND OF THE INVENTION

Gun grips are known which comprise a rear gripping portion, commonly called the "backstrap", which is removably fixed onto a grip body such that, when necessary, it may be replaced with others of a different finishing, material, shape and size in order to best suit the hand of the shooter for whom the gun is intended.

Prior art guns provide a number of embodiments of coupling or locking means between the backstrap and the grip body. A first example of known coupling means is a peg being arranged transversal to the backstrap and in a rear area of the grip between respective seats of the backstrap and the body.

In a second example of known coupling means, the backstrap has been provided as an integral part of an extension of the cartridge-housing magazine which is adapted to be inserted in the bottom of the grip body.

The known solutions suffer from some drawbacks. For example, the known solutions cannot ensure the optimum coupling of the backstrap to the body, while avoiding steps or incorrect alignment of the parts. In several solutions, a good level of coupling and continuity has been achieved between the body and the backstrap, though the provided coupling means have proved rather complicated both when being manufactured and when used by the shooter.

The problem at the heart of the present invention is to provide a firearm grip, particularly of a gun, which has such structural and functional characteristics as to overcome said drawbacks stated with reference to the prior art.

Particularly, the problem at the heart of the present invention is to provide a grip in which the backstrap can be firmly and effectively coupled with the body-without any step being present between the body and the backstrap, such that the shooter has a feeling of continuity of the grip.

A further problem at the heart of the present invention is to provide a variant embodiment of the known grips which is easier both to manufacture and to be used by the shooter.

SUMMARY OF THE INVENTION

This problem is solved by a firearm grip, particularly of a gun, in accordance with claim 1.

The dependent claims relate to further embodiments of the invention.

BRIEF DESCRIPTION OF THE DRAWINGS

Further characteristics and the advantages of the grip according to the invention will be understood from the description below of preferred embodiments thereof, which are given by way of a non-limiting illustration, with reference to the annexed figures, in which.

DETAILED DESCRIPTION OF THE INVENTION

Figure 1:
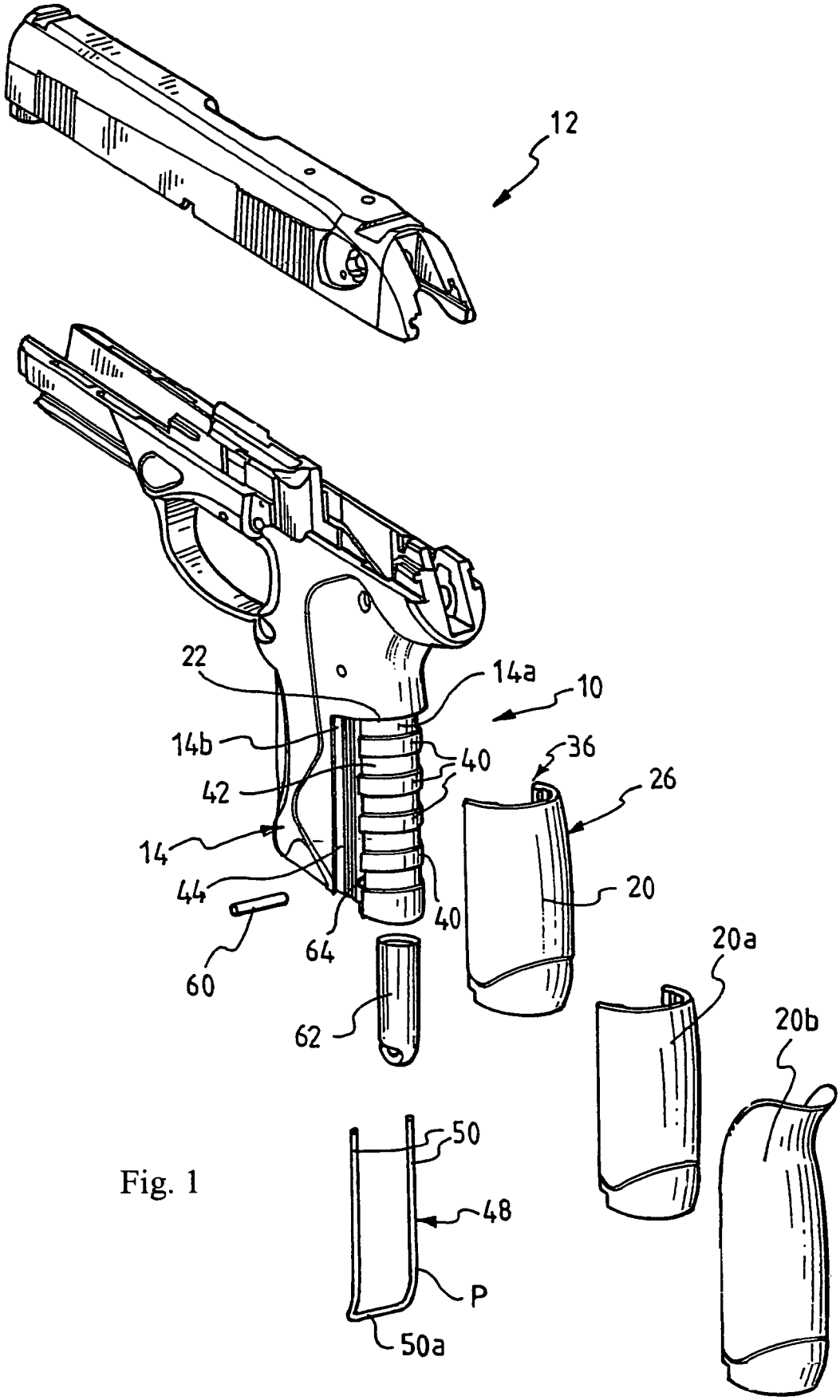
FIG. 1 shows an exploded perspective view of several components of a gun comprising a grip according to the present invention.

With reference to said figures, a grip of a firearm 12, particularly of a gun has been overall designated with 10.

A grip body substantially extending in a development direction 16 has been designated with 14. With reference to the shown embodiment, the development direction 16 of body 14 is arranged substantially transversal to a barrel of the gun, not shown. Advantageously, the body 14 of the grip 10 is provided as one piece with the portion adapted to house the gun barrel, thereby providing the so-called frame of the weapon.

A grip portion removably mounted on the body 14 in a rear area relative to a trigger of the weapon has been designated with 20.

In other words, referring to the grip 10 and the gun, the term "rear" will designate herein below a portion or a surface opposite the trigger or muzzle. Consequently, the term "front" will designate a portion or a surface arranged on the side of the trigger or muzzle, whereas the term "side" will indicate a joining portion or surface between the front portion and the rear portion. Furthermore, the terms "upper" and "lower" have been used with reference to the normal use of a weapon hold by a shooter and considering a vertical direction.

Advantageously, the gripping portion 20 partially covers the body 14. In other words, the gripping portion 20 is adapted to be a rest for a portion of the user's palm and forefinger, opposite the muzzle and trigger. In accordance with a conventional definition, the gripping portion 20 is also called the "backstrap".

In accordance with a possible embodiment, the gripping portion 20 is adapted to envelop and cover, at least partially, a rear surface 14*a* and a tract of side surfaces 14*b* of the body 14, relative to a plane transversal to the development direction 16 of the body. Preferably, the transversal section of the gripping portion 20 is substantially U-shaped, the curved connecting tract being adapted to cover the rear surface of the body 14, whereas both arms of the "U" are adapted to cover respective tracts of side surfaces of the body 14.

Advantageously, the body 14 has a notch 22 adapted to receive the gripping portion 20. In other words, the gripping portion 20 continues the surface of the body portions being adjacent to the gripping portion and the grip has a substantially continuous outer surface and without steps in the transition area between the body and the gripping portion.

The gripping portion 20 is advantageously adapted to be inserted on the body 14 in an inserting direction 24 transversal to the development direction 16 of body 14.

In accordance with a possible embodiment, the gripping portion 20 comprises an outer surface 26 adapted to be hold by the user and an inner surface 28 facing the body 14.

Figure 11:
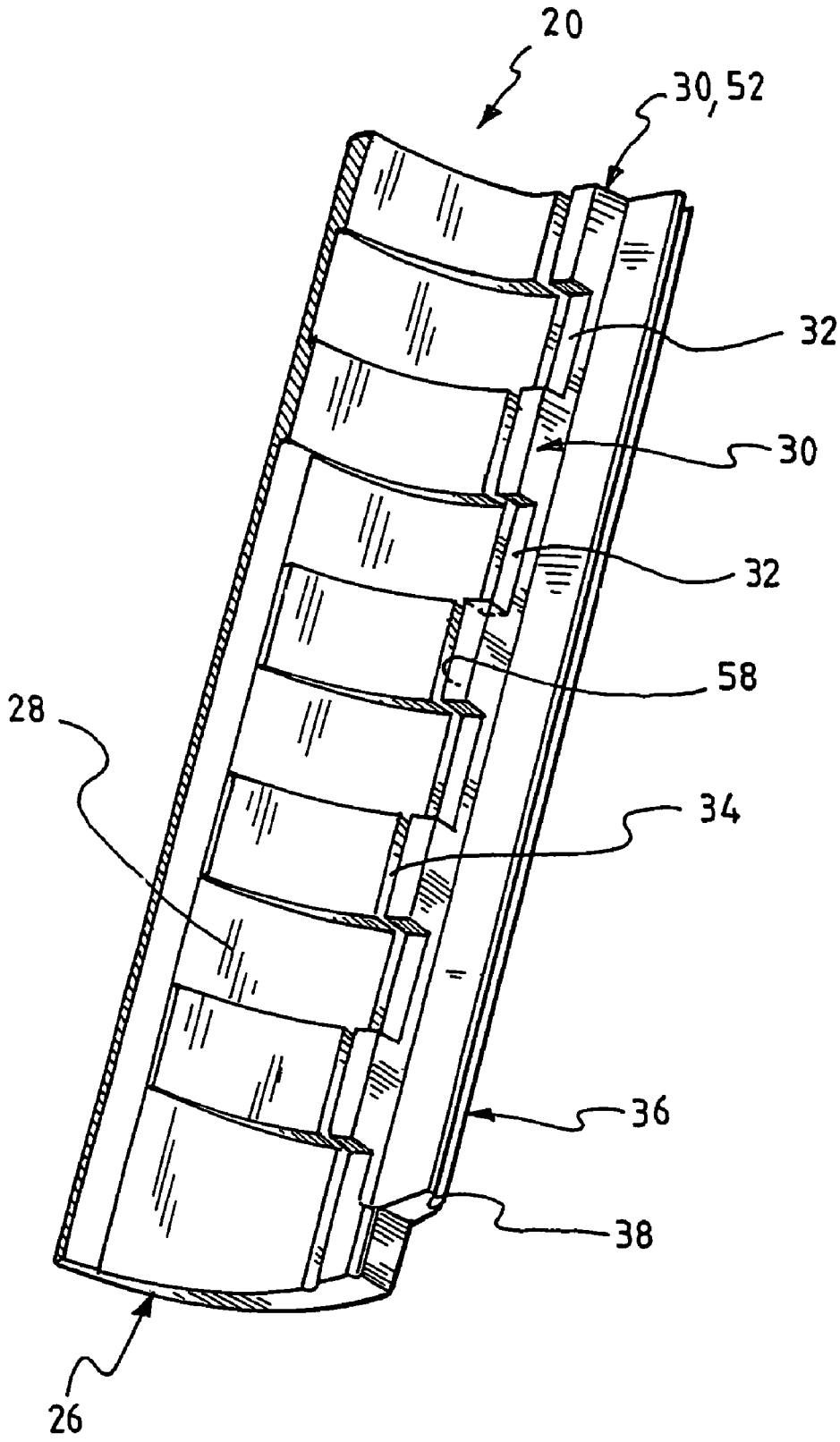
FIG. 11 shows a partially sectioned, perspective view, and from the inside, of a component of the grip according to the present invention.

Advantageously, the outer surface 26 can be either decorated or have relieves thereon or however be adapted to be properly and comfortably hold by the user. In FIG. 11 there is shown a half of the gripping portion 20, according to a possible embodiment, as seen from the inside thereof.

In accordance with a possible embodiment, from the inner surface 28 of the gripping portion 20 there extend first relieves 30. A first relief 30 advantageously develops in the direction transversal to the development direction 16 of the body 14 following the curvature of the gripping portion 20. In other words, a relief 30 extends in the gripping portion enveloping direction on the body.

According to a possible embodiment, a first relief 30 substantially extends along the rear portion and along the side portions of the gripping portion 20, optionally with different thicknesses, preferably decreasing from the side portion towards the rear portion (FIG. 11).

In accordance with a different embodiment, not shown, the first relieves can mostly extend only at the side portions of the gripping portion.

In accordance with the embodiment illustrated, the gripping portion 20 comprises a plurality of first relieves 30 repeating in the development direction 16 of the body 14 alternating with matching first recesses 32. In other words, considering a section of the gripping portion formed in a plane parallel to the main development direction 16 of the body 14, the edge of the inner surface 28 of the gripping portion 20 preferably has a substantially toothed shape.

With reference to a possible embodiment, a groove running in the development direction 16 of the body 14 has been designated with 34. When the first relieves 30 extend along the side and rear portions of the gripping portion, the groove 34 runs through the first relieves 30.

The groove 34 is preferably arranged in a side portion of the gripping portion. Still more preferably, each of the two side portions of the gripping portion has a respective groove 34.

In accordance with a possible embodiment, the side edges of the gripping portion 20 comprise a overhanging portion 36 having a lower thickness than the gripping portion and arranged towards the inner surface 28. Preferably, the overhanging portion 36 involves the whole height of the gripping portion 20 in the development direction 16 of body 14.

Advantageously, the overhanging portion 36, has a first inclined surface 38 arranged transversally between the inner surface 28 and the outer surface 26 of the gripping portion. Advantageously, the first inclined surface 38 is arranged such that the inner surface 28 continues beyond the outer-surface 26.

According to a possible embodiment, the body 14 comprises second relieves 40. Preferably, the second relieves 40 extend at the rear portion and at tracts of the side portions of the body 14. In other words, the second relieves 40 extend from the side surfaces 14*b* and the rear surface 14*a* of the body 14 facing the inner surface 28 of the gripping portion 20.

A second relief 40 develops in the direction transversal to the development direction 16 of body 14 following the curvature of the body. In other words, a second relief 40 extends in the gripping portion enveloping direction on the body 14.

Figure 7:
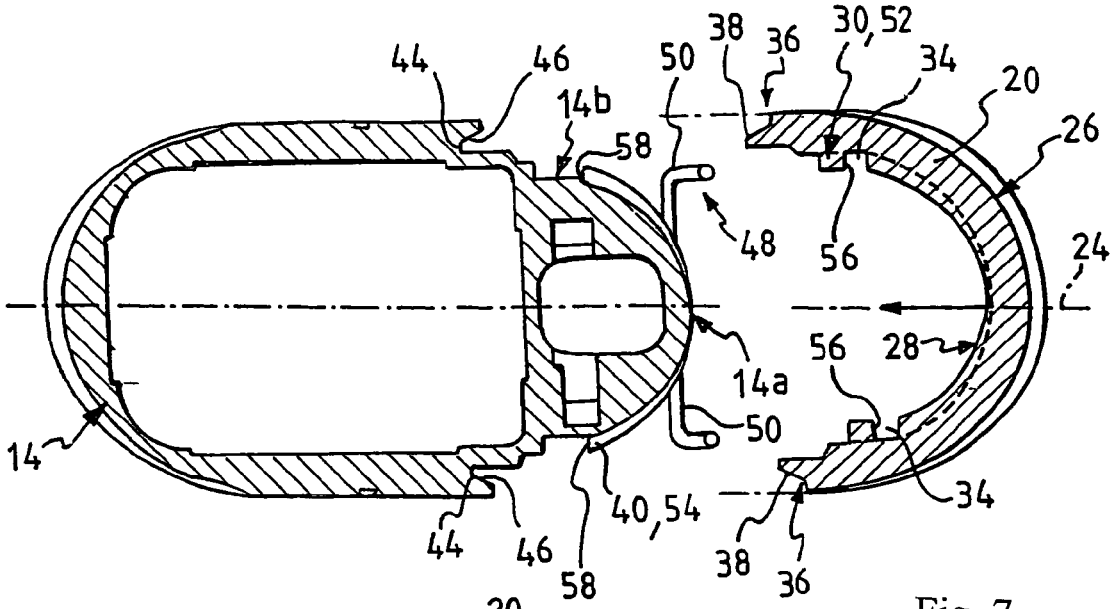
FIGS. 7 and 8 show a sectional view according to the line V-V from FIG. 4 of a grip according to the present invention in various assembly configurations.

In accordance with a possible embodiment, the second relieves 40 extend in the direction transversal to the development direction 16 of the body 14 with different thicknesses, preferably decreasing from the side portion to the rear portion (FIG. 7).

In accordance with a different embodiment, not shown, the second relieves 40 mostly extend at the side portions of the body.

In accordance with the shown embodiment, the body 14 comprises a plurality of second relieves 40 repeating along the development direction 16 of the body 14 alternating with corresponding second recesses 42. In other words, with reference to a section formed in a plane parallel to the main development direction 16 of the body 14, the edge of the rear or side portion of the body preferably has a substantially toothed shape.

Advantageously, the second relieves 40 repeat along the development direction 16 of the body 14 alternating with and offset relative to the first relieves 30, such that a first relief 30 of the gripping portion 20 is adapted to be inserted in a corresponding second recess 42 of the body 14 and a second relief 40 of the body 14 is adapted to be inserted in a first recess 32 of the gripping portion 20.

In accordance with a possible embodiment, the second relieves 40 of the body have a lower extension than the first relieves 30 of the gripping portion, with reference to the direction transversal to the development direction of the body. When the groove 34 is provided, the second relieves 40 of the body 14 advantageously end at this groove.

In accordance with a possible embodiment, the body comprises a seat 44 extending in the development direction 16 of the body, at side edges of the notch 22. Preferably, each of the side portions of the body 14 comprises a respective seat 44.

In accordance with a possible embodiment, the seat 44 involves the whole height of the gripping portion 20 in the development direction 16 of the body 14.

Advantageously, the seat 44 comprises a second inclined surface 46 arranged transversally between the side surface 14*b* and the outer surface of the body 14.

In accordance with a possible embodiment, the second inclined surface 46 is parallel and suitable to abut against the corresponding first inclined surface 38 of the gripping portion.

According to a possible embodiment, the grip 10 comprises interference means 48 comprising an interference element adapted to be inserted between the gripping portion 20 and the body 14 to lock the gripping portion on the body in the inserting direction 24, i.e. in a direction transversal to the development direction 16.

In accordance with a possible embodiment, the interference element comprises at least one substantially rectilinear bar 50.

The interference element is advantageously adapted to be inserted in a space 51 defined by the side surface 14*b* of the body 14 and the inner surface 28 of the gripping portion 20. For example, the interference element is suitable to be inserted along the groove 34 of the gripping portion.

Preferably, the interference element is adapted to be inserted in both side portions of the gripping portion and the body.

According to the embodiment illustrated in the annexed figures, the interference element is U-shaped, each rectilinear tract (the bar 50) is inserted in a side portion of the gripping portion and the body. Advantageously, the rectilinear tracts of the U-shaped interference element are at an angle in the vicinity of the respective connecting portion 50*a*. In other words, each bar 50 has a slight bending P such that the lower part of the U is slightly bent forward relative to the remaining rectilinear tract of the bars 50.

In accordance with the possible embodiments described above, the grip according to the present invention advantageously comprises means for locking the gripping portion 20 on the body 14 in the inserting direction of the gripping portion 24 on the body.

The locking means comprise first strikes 52 that are associated with the gripping portion 20 and offset in the development direction 16 of the body 14 relative to second strikes 54 being associated with the body. The locking means further comprise the interference means 48 interposed between the first and second strikes for locking the gripping portion in the inserting direction 24.

With reference with the embodiments shown and described above, the first relieves 30 define said first strikes 52 of the gripping portion, whereas the second relieves 40 define said second strikes 54 of the body. In other words, the first and second relieves define mutual first and second abutment surfaces 56, 58 adapted to interact with the interference means (FIG. 7). Advantageously, the first and second abutment surfaces extend in the development direction 16 of the body 14.

Particularly, an end portion of the first relieves 30 defines a first strike 52 and a first abutment surface 56 with the interference means. Similarly, an end portion of the second relieves 40 defines a second strike 54 and a second abutment surface 58 with the interference means. Advantageously, the first strike 52 and the first abutment surface 56 are defined by the groove 34.

With reference to the first relieves 30 and second relieves 40, the first and second abutment surfaces 56, 58 are respective head surfaces of the respective relieves.

Generally, in accordance with a possible embodiment, the locking means are arranged along at least one side portion of the body and the gripping portion, preferably along both side portions of the body and the gripping portion.

In accordance with the embodiment shown in the figures, the locking means comprise a plurality of first strikes 52 in the gripping portion which are arranged in the development direction 16 of the body and a plurality of second strikes 54 of the body which are arranged in the development direction 16 of the body. Particularly, the first strikes alternate with second strikes and are offset relative thereto in the development direction 16 of the body 14.

Advantageously, the first and second strikes 52, 54 are formed in respective mutually facing surfaces of the gripping portion and the body.

In accordance with a possible embodiment, the interference element develops along the development direction of the body and is inserted between the first strikes 52 and the second strikes 54 in the development direction 16 of the body 14.

In accordance with a possible embodiment, the grip according to the invention comprises guide means between the gripping portion 20 and the body 14 for the gripping portion to be inserted on the body according to the inserting direction 24 transversal to the development direction 16 of the body. Preferably, the guide means further define means for locking the gripping portion on the body in the development direction 16 of the body 14.

Advantageously, the guide means define the first strikes 52 and the second strikes 54 of the means for locking the gripping portion 20 on the body 14 operating in the inserting direction of the gripping portion 20 on the body.

According to a possible embodiment, the guide means define a shape coupling between the facing surfaces of the gripping portion 20 and the body 14. Furthermore, the shape coupling is suitable to lock the gripping portion 20 on the body 14 in the development direction 16 of the body.

Advantageously, the shape coupling between the facing surfaces of the gripping portion 20 and the body 14 extends transversally to the development direction 16, substantially in the gripping portion enveloping direction on the body.

In accordance with a possible embodiment, the shape coupling between the facing surfaces of the gripping portion and the body is repeated in the development direction 16 of the body.

With reference to the shown embodiment, the same first relieves 30 and second relieves 40 define said shape coupling and said guide means as well as the means for locking the gripping portion on the body in the development direction of the body.

In accordance with a possible embodiment, the grip according to the present invention comprises means for fastening the side edges of the gripping portion 20 on the body 14. Preferably, the fastening means comprise a shape coupling between the side edges of the gripping portion and the body.

With reference to the shown embodiment, the overhanging portion 36 and the respective seat 44 define said shape coupling. Preferably, the side edges of the gripping portion are provided to comprise the first inclined surface 38 suitable to abut against the corresponding second inclined surface 46 of the body 14. Advantageously, the outer surface of the gripping portion 20 is flush with the outer surface of the body portion 20 adjacent to the gripping portion.

With reference to the shown embodiment, a peg for fixing a plug 62 of the weapon frame has been designated with 60. The peg 60 is adapted to be housed in a through seat 64 of the body 14 arranged transversal to the development direction 16 between the two side surfaces 14*b* of the body 14. The gripping portion 20 mounted on the body 14 covers the peg 60 and the through seat 64. Advantageously, the interference element 48 is adapted to be arranged on the through seat 64 and the peg 60 in order to prevent the latter from coming off. Preferably, when the U-shaped interference element is provided, the peg is arranged at the bending P of the interference element.

Figure 2:
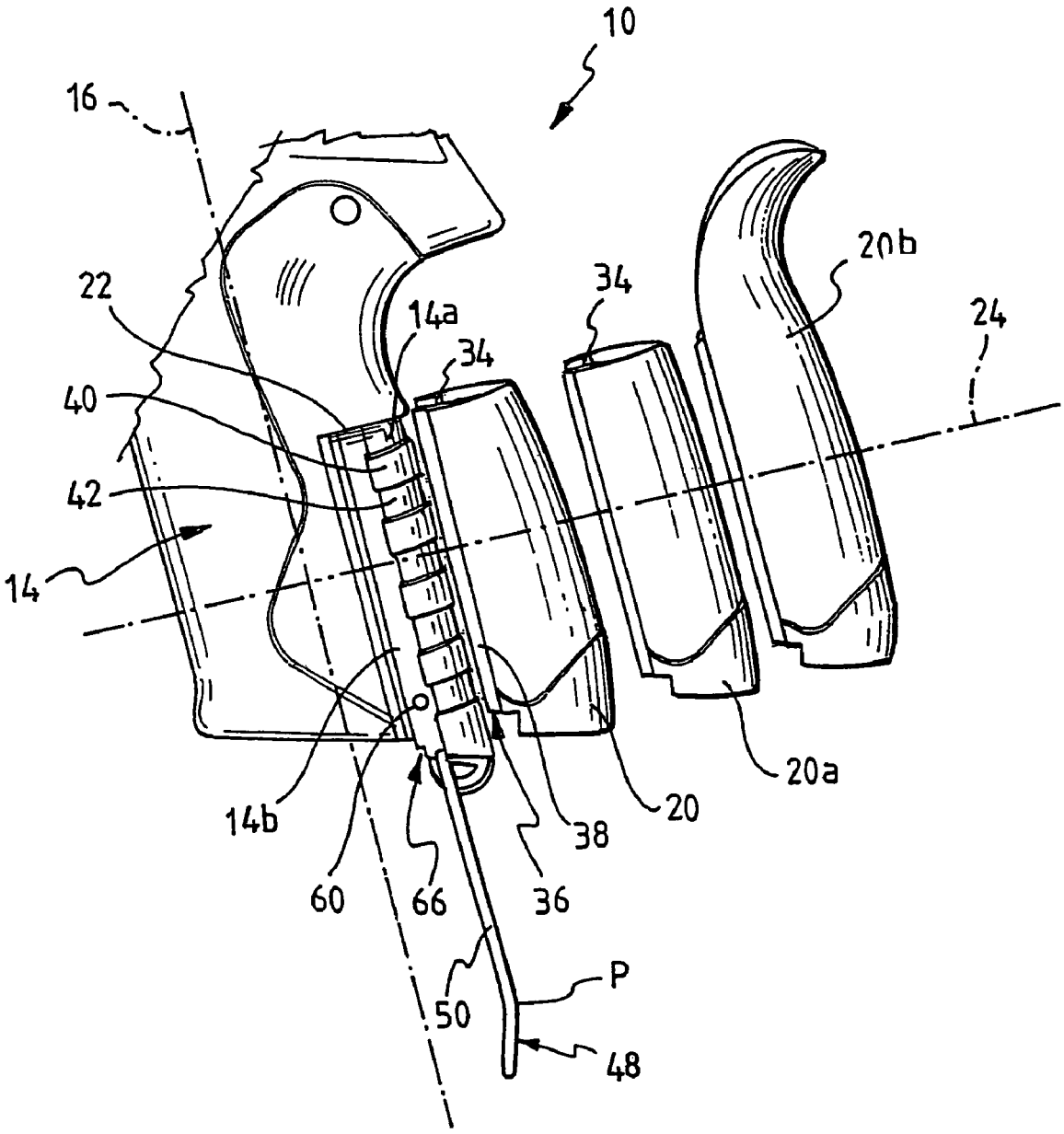
FIG. 2 shows a side view of a grip and a kit according to the present invention.
Figure 3:
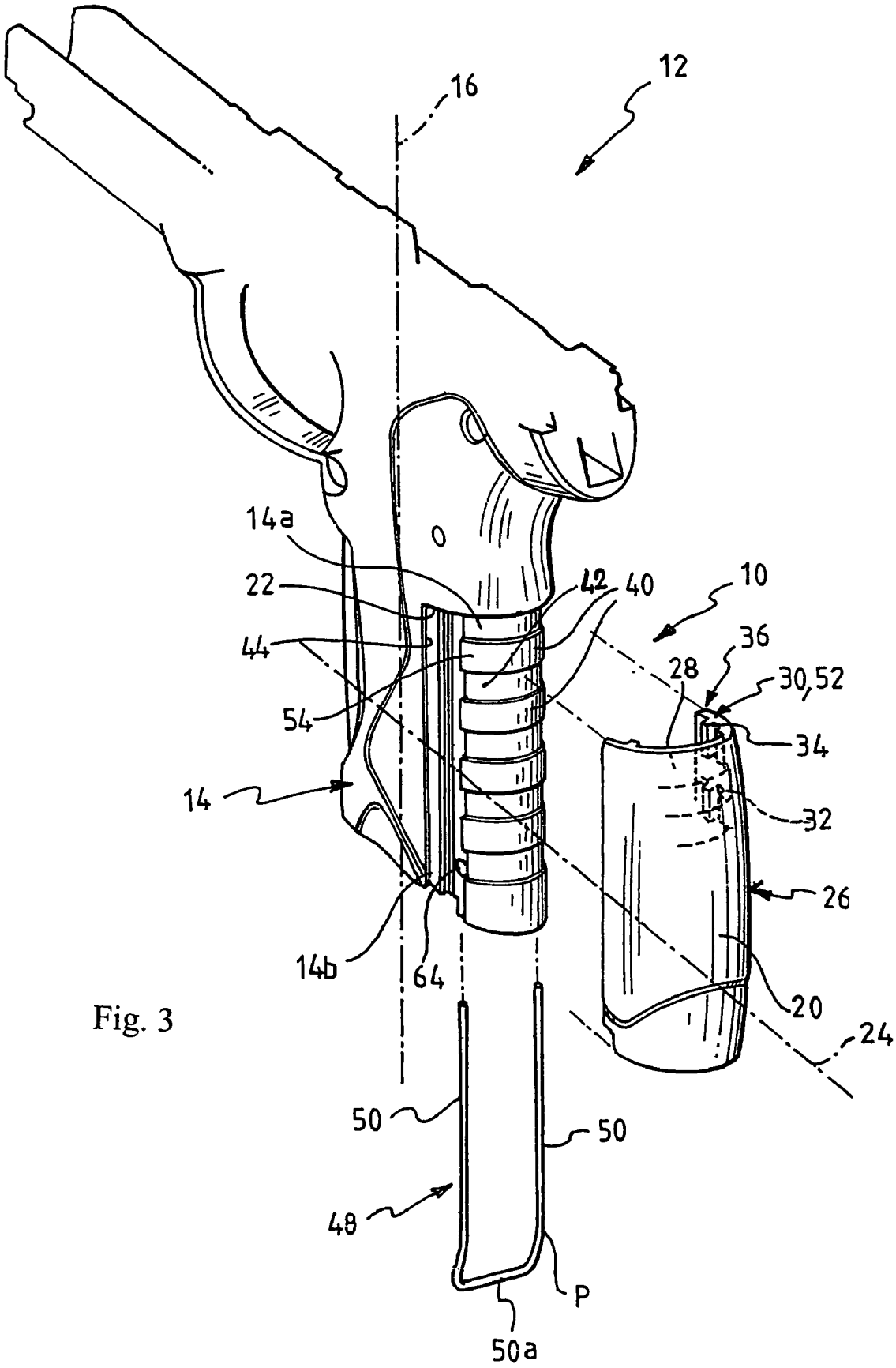
FIG. 3 shows an exploded perspective view of several components of the grip according to the present invention.

In accordance with a possible embodiment, the present invention further relates to a kit comprising a grip 10 provided with a gripping portion 20 and further gripping portions 20*a*, 20*b* that differ from each other by shape and/or size and/or material and/or surface finishing (FIGS. 1 and 2). Each further gripping portion 20*a*, 20*b* comprises the elements described above with reference to the gripping portion 20.

The method of assembly of the grip described above is described below with reference to the assembly of the gripping portion 20 on the body 14, such as illustrated in the annexed figures. FIG. 7-10 show a few assembly steps.

The selected gripping portion is approached to the body 14 in the inserting direction 24, i.e. transversal to the development direction 16 of the body 14 (FIG. 7).

The first relieves 30 of the gripping portion 20 slide between the second relieves 40, within the second recesses 42 of the body 14, thereby guiding the gripping portion 20 in position, such that the first strikes 52 alternate with and are offset relative to the second strikes 54.

The gripping portion 20 is inserted on the body 14 until the grooves 34 exceed the ends of the second relieves 40. The respective first and second abutment surfaces 56, 58 are arranged in a direction parallel to the development direction 16 of the body 14, alternating and offset in this direction, respectively. Furthermore, the respective first and second abutment surfaces 56, 58 mutually face inwards towards the respective groove 34 at a distance depending on the working tolerances and which should theoretically correspond to the width of the groove 34.

When the gripping portion are inserted on the body 14, the overhanging portions 36 of the gripping portion insert in the respective seats 44 of the body until the respective first and second inclined surfaces 38, 46 abut against each other.

In this condition, the gripping portion 20 envelops and encompasses the body 14 within the notch 22, such that the shooter does not feel any steps or irregularity between the body outer surface and the gripping portion.

Figure 8:
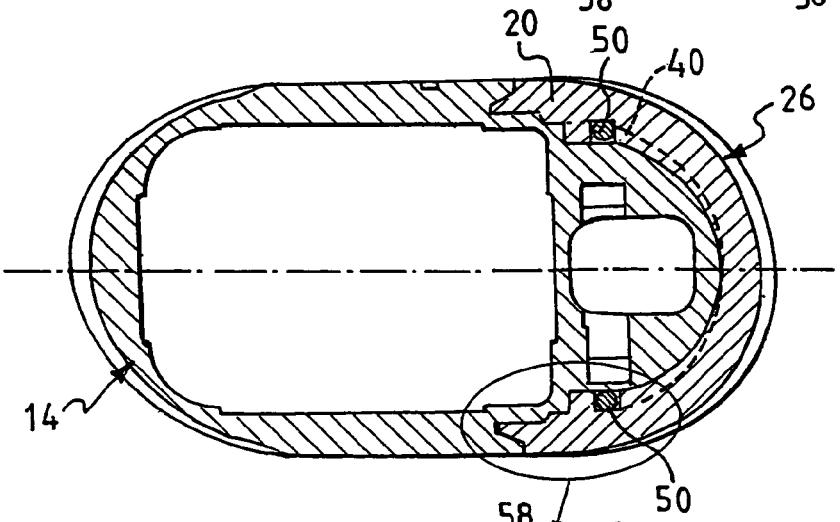

The interference means 48 and particularly the interference element is inserted along the groove 34, i.e. between the first abutment surfaces 56 and the second abutment surfaces 58. Particularly, by using a U-shaped interference element, both bars 50 fit into the respective grooves 34 whereas the connecting portion 50*a* of the "U" abuts against the lower part of the body. Advantageously, the grip body 14 comprises at least one step 66 adapted to receive the connecting portion 50*a*, particularly when the interference element 48 has a lower portion inclined forward. FIG. 8 shows a cross section of the assembled grip.

Figure 9:
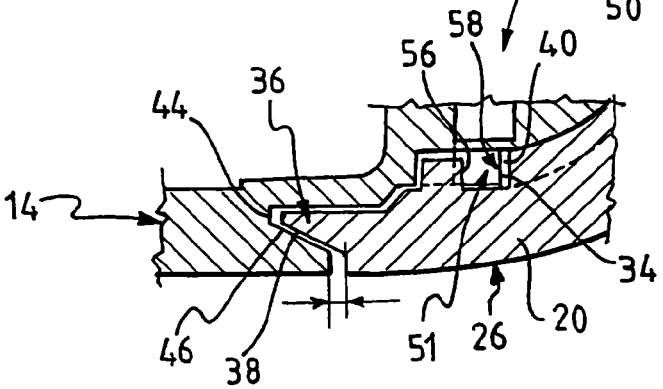
FIGS. 9 and 10 show an enlarged detail of FIG. 8 in various assembly configurations.
Figure 10:
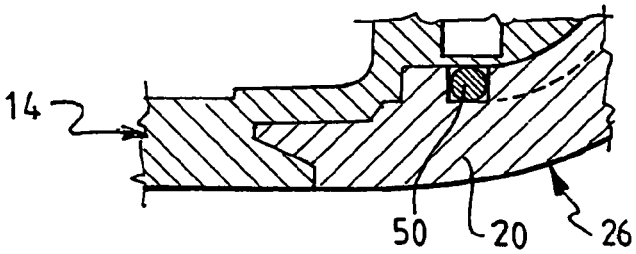

If the gripping portion is not perfectly inserted on the body due to slight working tolerances, the interference means will fit between the first abutment surfaces 56 and the second abutment surfaces 58 thereby moving them apart from each other and forcing the overhanging portions 36 inside the respective seats 44, such as illustrated for example in FIGS. 9 and 10.

After the assembly has been completed, the first and second relieves mutually cooperate in order to lock the gripping portion on the body, thereby avoiding that the latter may come off according to the development direction of the body. At the same time, the interference means prevent the gripping portion from coming off the body according to a direction transversal to the development direction of the body (i.e. according to the inserting direction).

Figure 4:
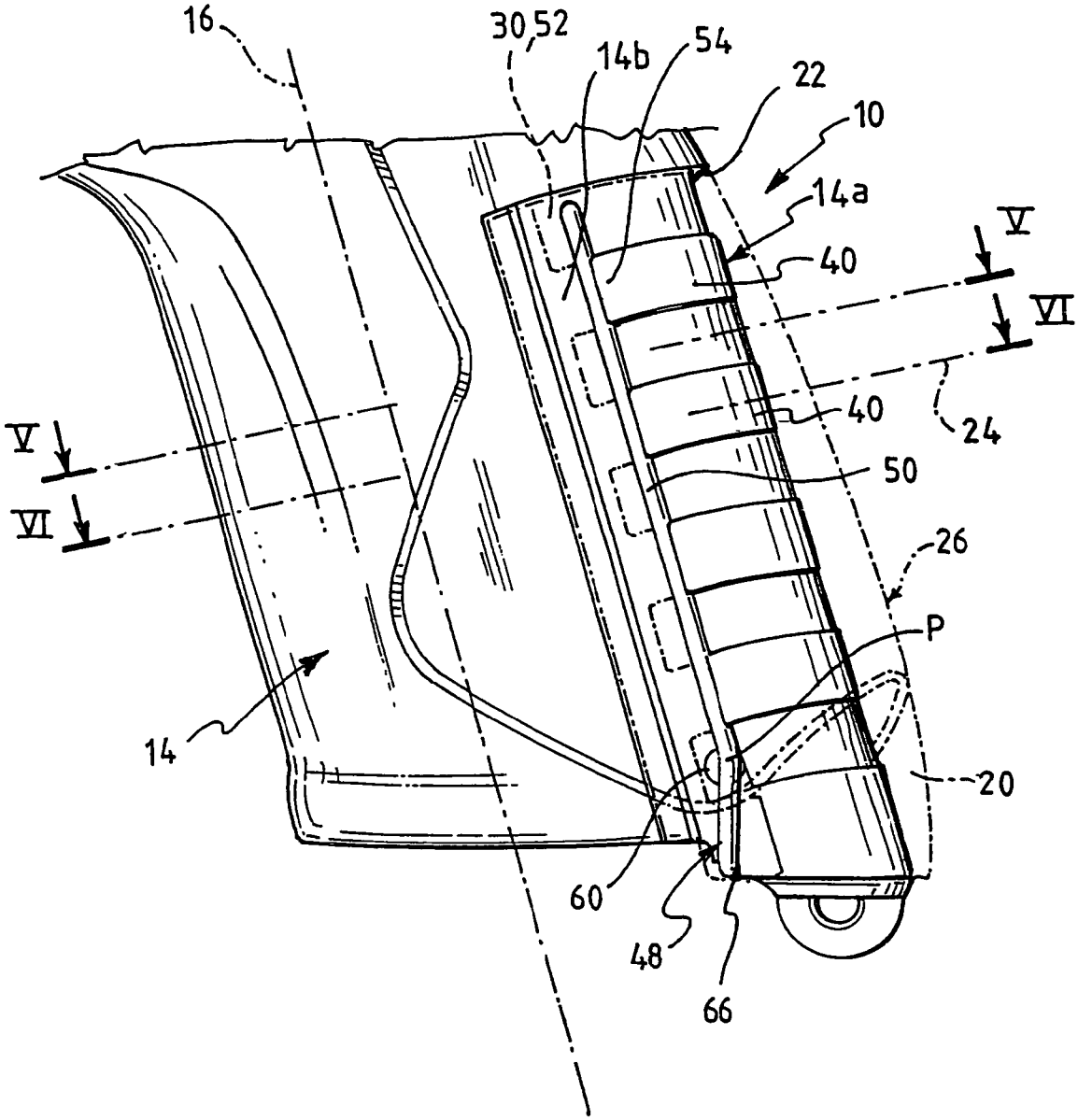
FIG. 4 shows a side view of a detail of the grip according to the present invention in which several components have been indicated with a dotted line in order to emphasize others.
Figure 5:
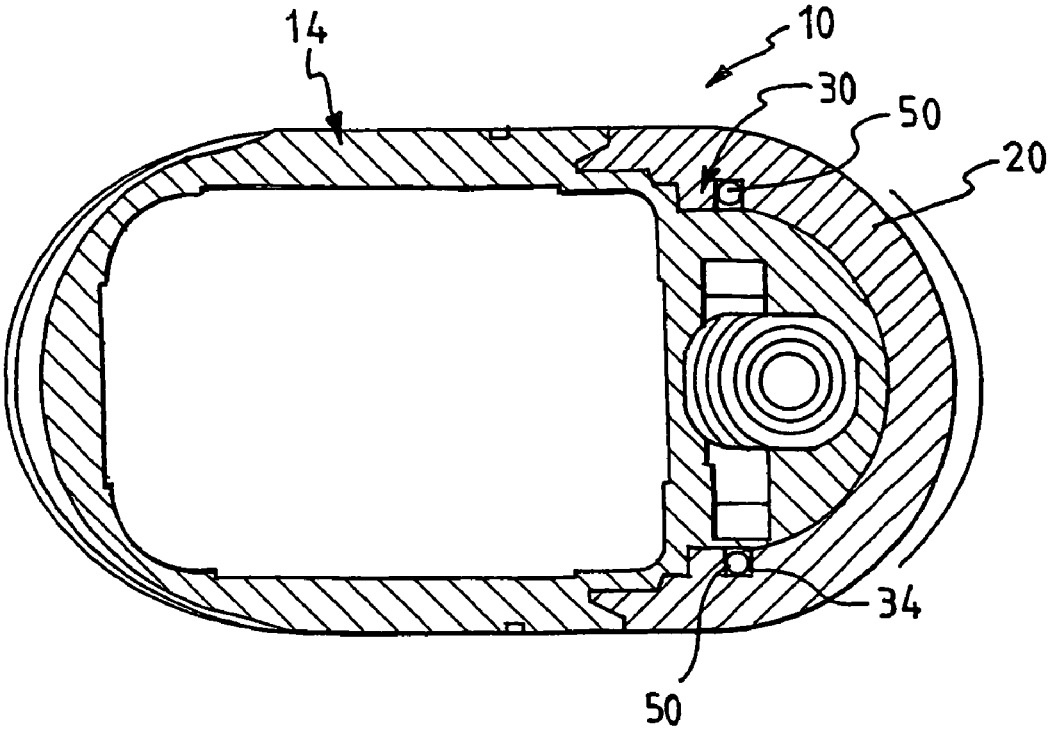
FIG. 5 is a section of the grip according to the line V-V from FIG. 4.
Figure 6:
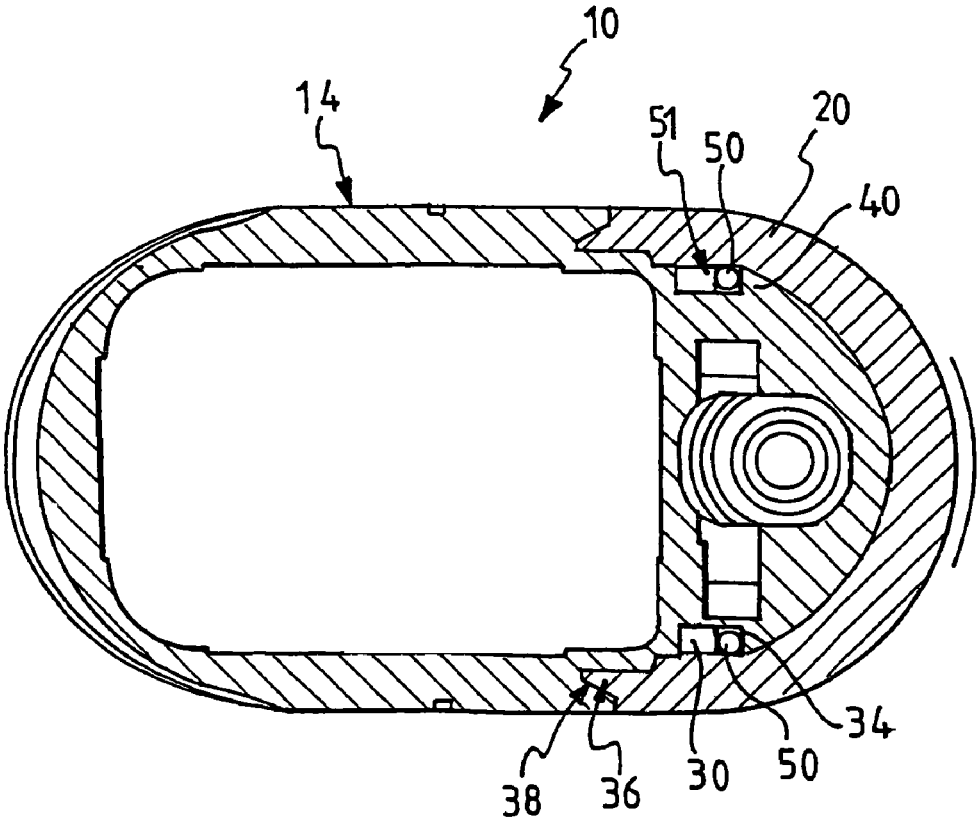
FIG. 6 is a section of the grip according to the line VI-VI from FIG. 4.

FIG. 4 shows the grip when assembled, the gripping portion 20 being marked with a dotted line and in phantom. The first relieves 30 (first strikes 52) are marked with a dotted line to show their position relative to the second relieves 40 (second strikes 54). The interference element 48 is inserted between the first and second strikes that are arranged alternating in the development direction 16. As a consequence, the fastening between the gripping portion and the body is distributed through the entire height of the gripping portion according to the development direction 16. Furthermore, both side portions of the gripping portion are fastened to the body.

To replace the gripping portion for example with another one from the kit available to the shooter, the interference element is removed from the respective grooves 34 in the development direction of the body. By advantageously providing a U-shaped interference element, the interference element can be grasped from the connecting portion 50*a* for the same to be removed below the grip.

Accordingly, the first and second strikes are free to mutually slide in the inserting direction 24 and the gripping portion can be removed from the body in the inserting direction, obviously in the opposite way to the actual insertion way.

From what has been stated above, it should be appreciated that a need particularly felt in the field, i.e. being able to replace the rear gripping portion (the backstrap) for example with others that best suit the shooter's grip, can be met by providing a grip according to the present invention.

This need is met by providing means for locking the gripping portion in the inserting direction, transversal to the development direction of the body. These means are advantageously arranged at side portions of the body and the gripping portions and operate in the development direction of the body. Due to this advantageous configuration, an effective lock of the gripping portion on the grip body in the inserting direction can be obtained. Advantageously, a single interference element can be provided for interacting between a plurality of abutment surfaces being provided along a side portion of the body and the gripping portion.

By advantageously providing an interference element, both the assembly and disassembly steps obtained by inserting or removing the interference element can be simplified. Furthermore, by extending the interference element in the development direction of the body, the locking function can be provided either on a plurality of abutment surfaces or abutment surfaces that also involve the entire height of the gripping portion.

By the advantageous configuration of the means for locking the gripping portion on the body, the interference elements can be introduced between the gripping portion and the body without then interfering with the shooter's grip.

By providing at least one relief on the body and gripping portion that are mutually offset in the development direction of the body, guide means can be obtained which facilitate the introduction of the gripping portion on the body. As a function of the shape and extension of the relieves, the guide means can advantageously define means for locking the gripping portion on the body in the development direction of the body.

A further advantage of the grip according to the invention is that, due to the uncommon structural simplicity of the same, it can be manufactured at a very low cost and used by the shooter in an immediate and intuitive manner.

It is understood that variants and/or additions to what has been described and illustrated above may be provided.

As an alternative to what has been shown in the annexed figures, only one first relief of the gripping portion and only one second relief of the body may be provided. Similarly, only one first strike of the gripping portion and only one second strike of the body can be provided.

According to a possible variant, the relieves can have a different shape or size from what has been illustrated in the figures. For example, the relieves can be provided only in the side portions of the gripping portion and the body. Particularly, the first relieves can only consist of the end portions outside the groove 34.

Advantageously, the interference means can be different from those illustrated. For example, either a right interference element and a left interference element, or only one interference element with a shape other than that illustrated may be provided.

The fastening means of the side edges can have a configuration other than that illustrated. For example, the overhanging portions and the respective seats can provide a step shape or other shapes allowing the edges of the gripping portion to be inserted within body seats.

According to a possible embodiment, the interference means can be introduced at the fastening means, by providing a through hole extending in the overhanging portion in the development direction of the body and respective through holes in the body for receiving the interference element.

To the preferred embodiment of the grip described above, those of ordinary skill in the art, aiming at satisfying contingent and specific needs, will be able to carry out a number of modifications, adaptations and replacements of elements with others functionally equivalent, without however departing from the scope of the claims below.

What is claimed is:

1. A grip of a firearm, particularly of a gun, comprising:

a body extending substantially along a development direction;

a gripping portion removably mounted in a rear portion of the body with reference to a trigger of the firearm, said gripping portion being adapted to envelop and at least partially cover a rear surface and at least portions of side surfaces of the body, with reference to a plane transversal to the development direction of the body;

means for locking the gripping portion of the body operating along an inserting direction of the gripping portion on the body, said inserting direction being substantially transversal to the development direction of the body;

wherein said locking means comprise at least one first strike associated with the gripping portion, at least one second strike associated with the body and interference means interposed between said first and second strikes for locking the gripping portion in the inserting direction;

and wherein said locking means are arranged in at least one side portion of the body and the gripping portion;

wherein said interference means comprise an interference element developing in the developing direction of the body and is inserted between said at least one first strike and said at least one second strike along the development direction of the body;

wherein said interference means comprises at least one substantially rectilinear bar;

wherein said at least one first strike is defined by a respective first relief extending from an inner surface of the gripping portion and said at least one second strike is defined by a second relief extending at least from a side surface of the body facing the gripping portion, said first and second relieves respectively defining first and second abutment surfaces adapted to interact with said interference means.

2. The grip according to claim 1, wherein said first and second abutment surfaces substantially extend in the development direction of the body.

3. The grip according to claim 1, wherein said first and second abutment surfaces are offset in the development direction of the body.

4. The grip according to claim 1, wherein said first and second abutment surfaces are respective end surfaces of said first and second relieves.

5. The grip according to claim 1, wherein said first and second relieves extend in a direction transversal to said development direction of the body between at least one side portion and a rear portion of the gripping portion and the body, respectively.

6. The grip according to claim 5, wherein the at least one side portion and the rear portion have thickness, and the thicknesses decrease from the side portion towards the rear portion.

7. The grip according to claim 1, wherein said gripping portion comprises a plurality of first relieves repeating in the development direction of the body and wherein said body comprises a plurality of second relieves repeating in the development direction of the body alternated and offset relative to the first relieves.

8. The grip according to claim 1, wherein said at least one first relief of the gripping portion has at least one groove developing substantially in the developing direction of the body for housing said interference means, said groove defining said at least one first strike and said first abutment surface.

9. A grip of a firearm, particularly of a gun, comprising:

a body extending substantially along a development direction;

a gripping portion removably mounted in a rear portion of the body with reference to a trigger of the firearm, said gripping portion being adapted to envelop and at least partially cover a rear surface and at least portions of side surfaces of the body, with reference to a plane transversal to the development direction of the body;

means for locking the gripping portion of the body operating along an inserting direction of the gripping portion on the body, said inserting direction being substantially transversal to the development direction of the body;

wherein said locking means comprise at least one first strike associated with the gripping portion, at least one second strike associated with the body and interference means interposed between said first and second strikes for locking the gripping portion in the inserting direction;

wherein said locking means are arranged in at least one side portion of the body and the gripping portion;

wherein said interference means comprise an interference element developing in the developing direction of the body and is inserted between said at least one first strike and said at least one second strike along the development direction of the body;

wherein said interference means comprises at least one substantially rectilinear bar.

10. The grip according to claim 9, wherein said interference element is adapted to be inserted in both side portions of the gripping portion and the body.

11. The grip according to claim 10, wherein said interference means is U-shaped and comprises two rectilinear tracts which are insertable into a respective side portion of the gripping portion and the body.

12. The grip according to claim 11, wherein the rectilinear tracts of said U-shaped interference element are at an angle in the vicinity of the respective connecting portion.

13. The grip according to claim 9, comprising guide means between the gripping portion and the body for inserting the gripping portion on the body in the inserting direction transversal to the development direction of the body.

14. The grip according to claim 13, wherein said guide means further define the locking means for the gripping portion on the body in the development direction of the body.

15. The grip according to claim 13, wherein said guide means define said at least one first strike and at least one second strike for said means for locking the gripping portion on the body operating in the inserting direction of the gripping portion on the body.

16. The grip according to claim 13, wherein said guide means define a shape coupling between facing surfaces of the gripping portion and of the body, said shape coupling being further adapted to lock the gripping portion on the body in the development direction of the body.

17. The grip according to claim 16, wherein said shape coupling between the facing surfaces of the gripping portion and of the body extends substantially in the enveloping direction of the gripping portion on the body.

18. The grip according to claim 16, wherein there are a plurality of shape couplings between the facing surfaces of the gripping portion and of the body.

19. The grip according to claim 16, wherein said shape coupling comprises at least one first relief of the gripping portion associated with at least one second relief of the body, said first and second relieves extending along a direction transversal to said development direction of the body.

20. The grip according to claim 19, wherein said at least one first relief defines said at least one first strike of the gripping portion and in which at least one second relief defines said at least one second strike of the body.

21. The grip according to claim 20, wherein said at least one first relief of the gripping portion has at least one groove developing in the development direction of the body for housing said interference means, defining said at least one first strike.

22. The grip according to claim 19, wherein said gripping portion comprises a plurality of first relieves repeating in the development direction of the body and wherein said body comprises a plurality of second relieves repeating in the development direction of the body alternated and offset relative to the first relieves.

23. The grip according to claim 9, comprising fastening means of the side edges of the gripping portion on the body.

24. The grip according to claim 23, wherein said fastening means comprise a shape coupling between the side edges of the gripping portion and the body.

25. The grip according to claim 24, wherein a side edge of the gripping portion comprises a overhanging portion arranged towards the inner surface of the gripping portion and wherein the body comprises a seat adapted to receive said overhanging portion.

26. The grip according to claim 25, wherein the overhanging portion and the respective seat involve substantially the entire height of the gripping portion and of the body, respectively, in the development direction.

27. The grip according to claim 24, wherein said gripping portion and said body comprise a first inclined surface and a second inclined surface adapted to abut against each other.

28. The grip according to claim 9, wherein an outer surface of the gripping portion is flush with the outer surface of the body portion adjacent to the gripping portion.

29. The grip according to claim 28, wherein the body comprises a notch adapted to receive the gripping portion.

30. The grip according to claim 9, wherein the body comprises a through seat for a peg suitable to lock a plug of the body and wherein said gripping portion covers said through seat and said peg.

31. A kit comprising a grip according to claim 9, provided with a gripping portion, and a plurality of further gripping portions that differ from each other by shape and/or size and/or finishing and/or material.

32. The grip according to claim 9, wherein said interference means are housed in a recess defined by said at least one first strike and said at least one second strike.

33. The grip according to claim 9, wherein said interference means is U-shaped.

34. The grip according to claim 9, wherein said means for locking the gripping portion on the body operating in the inserting direction extend along a direction substantially parallel to the development direction of the body.

35. The grip according to claim 9, wherein said means for locking the gripping portion on the body operating in the inserting direction extend in a direction substantially parallel to the respective side surface of the body.

36. The grip according to claim 9, wherein said means for locking the gripping portion on the body operating in the inserting direction are arranged between the side surface of the body and an inner surface of the gripping portion.

37. The grip according to claim 9, wherein said means for locking the gripping portion on the body operating in the inserting direction comprise at least one first strike associated to the gripping portion and offset substantially in the development direction of the body relative to at least one second strike associated to the body.

38. The grip according to claim 9, wherein said locking means are arranged at both side portions of the body and of the gripping portion.

39. The grip according to claim 9, wherein said locking means comprise a plurality of first strikes of the gripping portion substantially arranged in the development direction of the body and a plurality of second strikes of the body substantially arranged in the development direction of the body.

40. The grip according to claim 39, wherein the first strikes are alternative with the second strikes and are offset relative thereto substantially in the development direction of the body.

41. The grip according to claim 9, wherein said at least one first strike and said at least one second strike are associated to respective mutually facing surfaces of the gripping portion and of the body.

42. The grip according to claim 9, wherein said interference means are housed in a recess defined by the side surface of the body and by an inner surface of the gripping portion.

43. A grip of a firearm, particularly of a gun, comprising:

a body extending substantially along a development direction;

a gripping portion removably mounted in a rear portion of the body with reference to a trigger of the firearm, said gripping portion being adapted to envelop and at least partially cover a rear surface and at least portions of side surfaces of the body, with reference to a plane transversal to the development direction of the body;

means for locking the gripping portion of the body operating along an inserting direction of the gripping portion on the body, said inserting direction being substantially transversal to the development direction of the body;

guide means between the gripping portion and the body for inserting the gripping portion on the body in the inserting direction transversal to the development direction of the body; said guide means defining a shape coupling between facing surfaces of the gripping portion and of the body, said shape coupling comprising at least one first relief of the gripping portion associated with at least one second relief of the body, said first and second relieves extending along a direction transversal to said development direction of the body; and being further adapted to lock the gripping portion on the body in the development direction of the body;

wherein said at least one first relief defines said at least one first strike of the gripping portion and in which at least one second relief defines said at least one second strike of the body; and said at least one first relief of the gripping portion has at least one groove developing in the development direction of the body for housing said interference means, defining said at least one first strike;

wherein said locking means comprise at least one first strike associated with the gripping portion, at least one second strike associated with the body and interference means interposed between said first and second strikes for locking the gripping portion in the inserting direction;

wherein said locking means are arranged in at least one side portion of the body and the gripping portion;

wherein said interference means comprise an interference element developing in the developing direction of the body and is inserted between said at least one first strike and said at least one second strike along the development direction of the body; and wherein said interference means comprises at least one substantially rectilinear bar.

* * * * *